US008888506B2

(12) United States Patent
Nishimura et al.

(10) Patent No.: US 8,888,506 B2
(45) Date of Patent: Nov. 18, 2014

(54) CONNECTOR

(71) Applicants: Japan Aviation Electronics Industry, Limited, Tokyo (JP); JAE Electronics, Inc., Irvine, CA (US)

(72) Inventors: Takayuki Nishimura, Tokyo (JP); Joe Motojima, Irvine, CA (US)

(73) Assignees: Japan Aviation Electronics Industry, Limited, Tokyo (JP); JAE Electronics, Inc., Irvine, CA (US)

( * ) Notice: Subject to any disclaimer, the term of this patent is extended or adjusted under 35 U.S.C. 154(b) by 48 days.

(21) Appl. No.: 13/752,645

(22) Filed: Jan. 29, 2013

(65) Prior Publication Data

US 2014/0213079 A1 Jul. 31, 2014

(51) Int. Cl.
*H01R 12/00* (2006.01)
*H01R 12/70* (2011.01)

(52) U.S. Cl.
CPC ..... *H01R 12/7082* (2013.01)
USPC ..... 439/74

(58) Field of Classification Search
CPC ..... H01R 12/716
USPC ..... 439/74, 660
See application file for complete search history.

(56) References Cited

U.S. PATENT DOCUMENTS 5,876,217 A * 3/1999 Ito et al. ..... 439/74
5,885,092 A * 3/1999 Ito et al. ..... 439/74
5,888,076 A * 3/1999 Itoh et al. ..... 439/74
5,931,689 A * 8/1999 Patel ..... 439/346
5,975,916 A * 11/1999 Okura ..... 439/74
6,135,785 A * 10/2000 Niitsu ..... 439/74
6,257,900 B1 * 7/2001 Huang et al. ..... 439/74
6,296,524 B1 * 10/2001 Goto ..... 439/660
6,540,561 B1 * 4/2003 Masumoto ..... 439/660
6,623,308 B2 * 9/2003 Ono ..... 439/680
6,692,266 B2 * 2/2004 Hashiguchi et al. ..... 439/74
6,764,314 B1 * 7/2004 Lee ..... 439/65
6,811,411 B1 * 11/2004 Hirata et al. ..... 439/74

(Continued)

FOREIGN PATENT DOCUMENTS

JP 2004-55463 A 2/2004
JP 2010225351 A 10/2010
WO WO2008/139554 A1 11/2008

OTHER PUBLICATIONS

Japanese Office Action dated Jul. 3, 2014 in counterpart Japanese Application No. 2013-131627.

*Primary Examiner* — Ross Gushi
(74) *Attorney, Agent, or Firm* — Holtz, Holtz, Goodman & Chick PC

(57) ABSTRACT

A connector has a contact and a housing. The contact has a fixed portion, a contact portion, a spring portion and a held portion. The spring portion supports the contact portion. The held portion is located between the fixed portion and the spring portion. The housing has a sidewall portion and a bottom portion The sidewall portion is located outward of the spring portion in a predetermined direction and holds the held portion. The bottom portion is located under the spring portion in a vertical direction perpendicular to the predetermined direction. The housing has a gap between a lower surface of the spring portion and the bottom portion. The bottom portion and the sidewall portion hide the contact except the fixed portion both when the connector is seen from below along the vertical direction and when the connector is seen from the outside along the predetermined direction.

4 Claims, 5 Drawing Sheets

(56) References Cited

U.S. PATENT DOCUMENTS 6,827,588 B1 * 12/2004 Huang et al. ..... 439/74
6,846,187 B2 * 1/2005 Yu ..... 439/74
6,881,075 B2 * 4/2005 Huang et al. ..... 439/74
6,884,089 B2 * 4/2005 Obikane et al. ..... 439/74
6,923,659 B2 * 8/2005 Zhang et al. ..... 439/74
6,986,670 B2 * 1/2006 Okura et al. ..... 439/74
7,037,117 B2 * 5/2006 Goto ..... 439/74
7,070,423 B2 * 7/2006 Zhang et al. ..... 439/74
7,074,085 B2 * 7/2006 Chen ..... 439/607.36
7,090,508 B1 * 8/2006 Chen ..... 439/74
7,118,388 B2 * 10/2006 Midorikawa et al. ..... 439/74
7,125,260 B2 * 10/2006 Orita et al. ..... 439/74
7,128,581 B2 * 10/2006 Igarashi et al. ..... 439/74
7,172,433 B2 * 2/2007 Tsai ..... 439/74
7,195,494 B2 * 3/2007 Ookura ..... 439/74
7,195,495 B2 * 3/2007 Takano et al. ..... 439/74
7,232,317 B2 * 6/2007 Ookura ..... 439/74
7,247,029 B2 * 7/2007 Chen ..... 439/66
7,278,861 B2 * 10/2007 Kishi et al. ..... 439/74
7,287,988 B1 * 10/2007 Peng et al. ..... 439/74
7,320,605 B2 * 1/2008 Chang et al. ..... 439/74
7,320,606 B2 * 1/2008 Midorikawa ..... 439/74
7,338,318 B2 * 3/2008 Shen et al. ..... 439/571
7,344,386 B2 * 3/2008 Michida ..... 439/74
7,344,387 B2 * 3/2008 Shiroyama ..... 439/74
7,354,279 B2 * 4/2008 Uesaka ..... 439/74
7,367,816 B2 * 5/2008 Liu ..... 439/74
7,374,432 B2 * 5/2008 Koguchi et al. ..... 439/74
7,384,274 B1 * 6/2008 Chen et al. ..... 439/74
7,387,540 B1 * 6/2008 Van der Steen ..... 439/660
7,390,196 B2 * 6/2008 Sasaki ..... 439/74
7,402,054 B2 * 7/2008 Peng et al. ..... 439/74
7,410,364 B2 * 8/2008 Kishi et al. ..... 439/74
7,413,444 B2 * 8/2008 Wang ..... 439/74
7,425,158 B2 * 9/2008 Ookura ..... 439/660
7,445,466 B1 * 11/2008 Peng ..... 439/74
7,445,514 B2 * 11/2008 Cao et al. ..... 439/660
7,465,171 B2 * 12/2008 Miyazaki et al. ..... 439/74
7,467,954 B2 * 12/2008 Shiu ..... 439/74
7,484,969 B2 * 2/2009 Shiu ..... 439/74
7,494,346 B1 * 2/2009 Peng ..... 439/74
7,497,697 B2 * 3/2009 Hoshino et al. ..... 439/74
7,547,236 B1 * 6/2009 Chen ..... 439/660
7,568,919 B2 * 8/2009 Hoshino et al. ..... 439/74
7,585,185 B2 * 9/2009 Obikane ..... 439/607.01
7,588,443 B2 * 9/2009 Wu et al. ..... 439/74
7,635,274 B2 * 12/2009 Fukazawa et al. ..... 439/247
7,637,786 B2 * 12/2009 Hoshino et al. ..... 439/660
7,658,636 B2 * 2/2010 Takeuchi et al. ..... 439/357
7,674,115 B2 * 3/2010 Midorikawa ..... 439/74
7,674,135 B2 * 3/2010 Zeng ..... 439/660
7,677,903 B1 * 3/2010 Huang et al. ..... 439/74
7,717,719 B2 * 5/2010 Miyazaki et al. ..... 439/74
7,722,408 B2 * 5/2010 Miyazaki et al. ..... 439/660
7,726,979 B2 * 6/2010 Lei et al. ..... 439/74
7,736,177 B2 * 6/2010 Tsai ..... 439/570
7,744,377 B2 * 6/2010 Wu et al. ..... 439/74
7,748,993 B2 * 7/2010 Midorikawa et al. ..... 439/74
7,748,994 B1 * 7/2010 Peng et al. ..... 439/74
7,758,352 B2 * 7/2010 Zeng ..... 439/74
RE41,473 E * 8/2010 Hirata et al. ..... 439/74
7,766,666 B1 * 8/2010 Chen et al. ..... 439/65
7,789,673 B2 * 9/2010 Lee et al. ..... 439/74
7,794,238 B2 * 9/2010 Chen et al. ..... 439/74
7,828,559 B2 * 11/2010 Chen et al. ..... 439/74
7,833,024 B2 * 11/2010 Takeuchi et al. ..... 439/74
7,835,160 B2 * 11/2010 Yamamoto et al. ..... 361/792
7,845,958 B2 * 12/2010 Hoshino et al. ..... 439/74
7,845,987 B2 * 12/2010 Yamada et al. ..... 439/680
7,901,218 B2 * 3/2011 Sato et al. ..... 439/74
7,922,499 B2 * 4/2011 Liao ..... 439/74
7,931,477 B2 * 4/2011 Hirata et al. ..... 439/74
7,946,888 B2 * 5/2011 Wu et al. ..... 439/626
7,950,929 B2 * 5/2011 Yu ..... 439/74
7,985,099 B2 * 7/2011 Wu ..... 439/626
7,993,146 B2 * 8/2011 Midorikawa ..... 439/74
8,083,527 B2 * 12/2011 Takeuchi et al. ..... 439/65
8,087,942 B2 * 1/2012 Chen ..... 439/74
8,092,232 B2 * 1/2012 Takeuchi ..... 439/74
8,105,112 B2 * 1/2012 Midorikawa et al. .... 439/607.35
8,109,771 B2 * 2/2012 Chen ..... 439/74
8,182,272 B2 * 5/2012 Ooi ..... 439/74
8,235,733 B2 * 8/2012 Yamashiro et al. ..... 439/83
8,267,698 B2 * 9/2012 Ishikawa et al. ..... 439/17
8,272,881 B2 * 9/2012 Miyazaki et al. ..... 439/74
8,292,635 B2 * 10/2012 Little et al. ..... 439/74
8,308,492 B2 * 11/2012 Takeuchi et al. ..... 439/74
8,337,218 B2 * 12/2012 Hirata et al. ..... 439/83
8,342,875 B2 * 1/2013 Takeuchi ..... 439/374
8,398,425 B2 * 3/2013 Suzuki et al. ..... 439/374
8,408,931 B2 * 4/2013 Sato et al. ..... 439/357
8,465,298 B2 * 6/2013 Takeuchi et al. ..... 439/74
8,469,722 B2 * 6/2013 Huang ..... 439/74
8,485,832 B2 * 7/2013 Mashiyama et al. ..... 439/74
8,500,460 B2 * 8/2013 Huang et al. ..... 439/74
8,523,580 B2 * 9/2013 Midorikawa et al. ..... 439/74
8,540,534 B2 * 9/2013 Sato et al. ..... 439/660
8,556,640 B2 * 10/2013 Mashiyama et al. ..... 439/74
8,562,379 B2 * 10/2013 Miyazaki et al. ..... 439/660
2001/0027036 A1 * 10/2001 Goto ..... 439/74
2004/0014335 A1 * 1/2004 Igarashi et al. ..... 439/74
2004/0063344 A1 * 4/2004 Shin ..... 439/74
2004/0142586 A1 * 7/2004 Yu ..... 439/74
2004/0157478 A1 * 8/2004 Midorikawa et al. ..... 439/74
2004/0171285 A1 * 9/2004 Okura ..... 439/74
2004/0185690 A1 * 9/2004 Huang ..... 439/74
2004/0253848 A1 * 12/2004 Huang et al. ..... 439/74
2005/0009379 A1 * 1/2005 Huang et al. ..... 439/65
2005/0009383 A1 * 1/2005 Okura et al. ..... 439/74
2005/0026466 A1 * 2/2005 Kubo ..... 439/74
2005/0032400 A1 * 2/2005 Zhang et al. ..... 439/74
2005/0032434 A1 * 2/2005 Zhang et al. ..... 439/660
2005/0070137 A1 * 3/2005 Goto ..... 439/74
2005/0101163 A1 * 5/2005 Obikane et al. ..... 439/74
2005/0191877 A1 * 9/2005 Huang ..... 439/74
2006/0040525 A1 * 2/2006 Takano et al. ..... 439/74
2006/0051988 A1 * 3/2006 Okura et al. ..... 439/74
2006/0063432 A1 * 3/2006 Chen ..... 439/607
2006/0089018 A1 * 4/2006 Orita et al. ..... 439/74
2006/0116008 A1 * 6/2006 Chen ..... 439/74
2006/0141811 A1 * 6/2006 Shichida et al. ..... 439/63
2006/0178022 A1 * 8/2006 Liu ..... 439/74
2006/0183358 A1 * 8/2006 Iida et al. ..... 439/74
2006/0199403 A1 * 9/2006 Tsai ..... 439/74
2006/0234525 A1 * 10/2006 Ookura ..... 439/74
2006/0258227 A1 * 11/2006 Ookura ..... 439/660
2006/0264074 A1 * 11/2006 Chang et al. ..... 439/74
2006/0264075 A1 * 11/2006 Obikane et al. ..... 439/74
2006/0276060 A1 * 12/2006 Takano ..... 439/74
2006/0276061 A1 * 12/2006 Koguchi et al. ..... 439/74
2006/0276075 A1 * 12/2006 Iida et al. ..... 439/492
2007/0020966 A1 * 1/2007 Lee et al. ..... 439/74
2007/0020967 A1 * 1/2007 Midorikawa ..... 439/74
2007/0026708 A1 * 2/2007 Shiroyama ..... 439/157
2007/0093085 A1 * 4/2007 Kenjo ..... 439/74
2007/0105408 A1 * 5/2007 Ookura ..... 439/74
2007/0141866 A1 * 6/2007 Kishi et al. ..... 439/74
2007/0141867 A1 * 6/2007 Kishi et al. ..... 439/74
2007/0173131 A1 * 7/2007 Chen ..... 439/660
2007/0218716 A1 * 9/2007 Liu ..... 439/74
2007/0232092 A1 * 10/2007 Michida ..... 439/74
2007/0264854 A1 * 11/2007 Sasaki ..... 439/188
2007/0275575 A1 * 11/2007 Wang ..... 439/74
2008/0026609 A1 * 1/2008 Kuwana et al. ..... 439/74
2008/0081503 A1 * 4/2008 Hoshino et al. ..... 439/345
2008/0081506 A1 * 4/2008 Hoshino et al. ..... 439/374
2008/0139019 A1 * 6/2008 Shiu ..... 439/83
2008/0153349 A1 * 6/2008 Shiu ..... 439/563
2008/0207014 A1 * 8/2008 Takeuchi et al. ..... 439/74
2008/0214051 A1 * 9/2008 Obikane ..... 439/610
2008/0268711 A1 * 10/2008 Miyazaki et al. ..... 439/626
2008/0268723 A1 * 10/2008 Miyazaki et al. ..... 439/889
2008/0299796 A1 * 12/2008 Hoshino et al. ..... 439/72
2008/0305657 A1 * 12/2008 Midorikawa ..... 439/74

(56) References Cited

U.S. PATENT DOCUMENTS

2009/0023312 A1* 1/2009 Zeng ..... 439/74
2009/0029572 A1* 1/2009 Midorikawa ..... 439/74
2009/0029592 A1* 1/2009 Matsuzaki et al. ..... 439/607
2009/0029598 A1* 1/2009 Yamaji et al. ..... 439/660
2009/0053939 A1* 2/2009 Tsai ..... 439/682
2009/0061655 A1* 3/2009 Miyazaki et al. ..... 439/74
2009/0176386 A1* 7/2009 Wu ..... 439/74
2009/0197440 A1* 8/2009 Hirata et al. ..... 439/83
2009/0221156 A1* 9/2009 Lee et al. ..... 439/66
2009/0221157 A1* 9/2009 Midorikawa et al. ..... 439/70
2009/0227138 A1* 9/2009 Lv et al. ..... 439/466
2009/0239421 A1* 9/2009 Fukazawa et al. ..... 439/660
2009/0280658 A1* 11/2009 Hoshino et al. ..... 439/66
2009/0305528 A1* 12/2009 Hirata et al. ..... 439/74
2009/0318029 A1* 12/2009 Takeuchi et al. ..... 439/630
2009/0325396 A1* 12/2009 Takeuchi ..... 439/65
2010/0048041 A1* 2/2010 Lei et al. ..... 439/74
2010/0068900 A1* 3/2010 Wu et al. ..... 439/74
2010/0130068 A1* 5/2010 Peng ..... 439/660
2010/0136841 A1* 6/2010 Midorikawa ..... 439/638
2010/0149777 A1* 6/2010 Yamamoto et al. ..... 361/790
2010/0151702 A1* 6/2010 Chen et al. ..... 439/65
2010/0159717 A1* 6/2010 Takeuchi ..... 439/65
2010/0190383 A1* 7/2010 Yamada et al. ..... 439/680
2010/0221928 A1* 9/2010 Sato et al. ..... 439/74
2010/0230709 A1* 9/2010 Kanno ..... 257/99
2010/0248520 A1* 9/2010 Miyazaki et al. ..... 439/345
2010/0267287 A1* 10/2010 Ishikawa et al. ..... 439/700
2010/0291776 A1* 11/2010 Huang et al. ..... 439/74
2010/0330821 A1* 12/2010 Takeuchi et al. ..... 439/65
2011/0045679 A1* 2/2011 Yu ..... 439/66
2011/0045708 A1* 2/2011 Ooi ..... 439/676
2011/0065299 A1* 3/2011 Zhu ..... 439/190
2011/0070752 A1* 3/2011 Yamashiro et al. ..... 439/83
2011/0097936 A1* 4/2011 Hirata ..... 439/626
2011/0111648 A1* 5/2011 Takeuchi et al. ..... 439/884
2011/0136379 A1* 6/2011 Midorikawa et al. .... 439/607.01
2011/0165797 A1* 7/2011 Takeuchi et al. ..... 439/660
2011/0195610 A1* 8/2011 Miyazaki et al. ..... 439/660
2011/0201226 A1* 8/2011 Suzuki et al. ..... 439/374
2011/0201227 A1* 8/2011 Takeuchi ..... 439/374
2011/0263140 A1* 10/2011 Sato et al. ..... 439/74
2011/0312221 A1* 12/2011 Takeuchi et al. ..... 439/626
2012/0003875 A1* 1/2012 Akai et al. ..... 439/660
2012/0052711 A1* 3/2012 Hasegawa ..... 439/345
2012/0094544 A1* 4/2012 Sato et al. ..... 439/660
2012/0142226 A1* 6/2012 Funayama et al. ..... 439/692
2012/0214353 A1* 8/2012 Midorikawa ..... 439/733.1
2012/0231637 A1* 9/2012 Takeuchi et al. ..... 439/65
2013/0012039 A1* 1/2013 Nose et al. ..... 439/74
2013/0023162 A1* 1/2013 Harlan ..... 439/660
2013/0065460 A1* 3/2013 Hirata ..... 439/884
2013/0084717 A1* 4/2013 Huang et al. ..... 439/65
2013/0137306 A1* 5/2013 Huang ..... 439/660
2013/0137307 A1* 5/2013 Huang et al. ..... 439/660
2013/0137308 A1* 5/2013 Chiang et al. ..... 439/660
2013/0203272 A1* 8/2013 Miyazaki ..... 439/65
2013/0210270 A1* 8/2013 Takeuchi et al. ..... 439/488
2013/0210281 A1* 8/2013 Huang et al. ..... 439/638
2013/0217270 A1* 8/2013 Miyazaki ..... 439/660
2013/0260587 A1* 10/2013 Chen ..... 439/284
2013/0260588 A1* 10/2013 Chen ..... 439/284
2013/0260589 A1* 10/2013 Chen ..... 439/284
2013/0309895 A1* 11/2013 Nishimura et al. ..... 439/345
2013/0316598 A1* 11/2013 Yoshioka et al. ..... 439/733.1
2013/0330943 A1* 12/2013 Sasaki et al. ..... 439/74
2013/0330970 A1* 12/2013 Hirata ..... 439/620.01
2014/0094072 A1* 4/2014 Seki et al. ..... 439/887
2014/0099804 A1* 4/2014 Kobuchi et al. ..... 439/66
2014/0120780 A1* 5/2014 Nishimura et al. ..... 439/660

* cited by examiner

CONNECTOR

BACKGROUND OF THE INVENTION

This invention relates to a connector configured to be mounted on a circuit board.

As shown in FIG. 1, a connector disclosed in JP-A 2004-55463 comprises a housing made of an insulating material and contacts held by the housing. The contacts are press-fit in the housing from above.

As shown in FIG. 2, a connector disclosed in WO 2008/139554 comprises a housing made of an insulating material and contacts held by the housing. The housing is formed from two members. Each of the contacts is partially embedded in one of the members of the housing via insert-molding.

As for the connector of JP-A 2004-55463, the housing is required to have an outer surface formed with a region where a fixed portion of the contact passes through when the contact is press-fit into the housing. Accordingly, the contact is visible when the outer surface of the housing is seen from the outside. Thus, the contact may be exposed to moisture or gases through the outer surface of the housing. The contact therefore may be rusted.

The housing of WO 2008/139554 has a hole which opens at a bottom portion thereof. The hole is located right under the contact. Accordingly, the contact may be exposed to moisture or gases through the bottom portion of the housing. The contact therefore may be rusted. Moreover, the contact may be contaminated by scattered flux or solder when the connector is attached to a circuit board.

SUMMARY OF THE INVENTION

It is therefore an object of the present invention to provide a connector having a contact configured to be less exposed, particularly in a mated state, and less contaminated.

One aspect (first aspect) of the present invention provides a connector configured to be mounted on a circuit board. The connector comprises a contact and a housing. The contact has a fixed portion, a contact portion, a spring portion and a held portion. The fixed portion is configured to be fixed to the circuit board. The spring portion supports the contact portion. The held portion is located between the fixed portion and the spring portion. The housing has a sidewall portion and a bottom portion. The sidewall portion is located outward of the spring portion in a predetermined direction and holds the held portion. The bottom portion is located under the spring portion in a vertical direction perpendicular to the predetermined direction. The housing has a gap between a lower surface of the spring portion and the bottom portion. The bottom portion and the sidewall portion hide the contact except the fixed portion both when the connector is seen from below along the vertical direction and when the connector is seen from outside along the predetermined direction.

An appreciation of the objectives of the present invention and a more complete understanding of its structure may be had by studying the following description of the preferred embodiment and by referring to the accompanying drawings.

Figure 1:
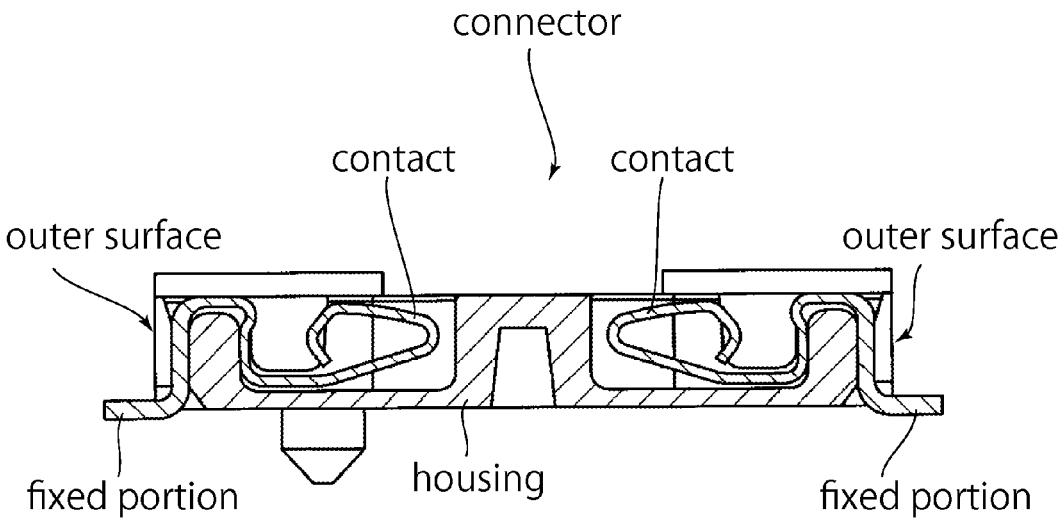
PRIOR ART FIG. 1
FIG. 1 is a cross-sectional view showing an existing connector.
Figure 2:
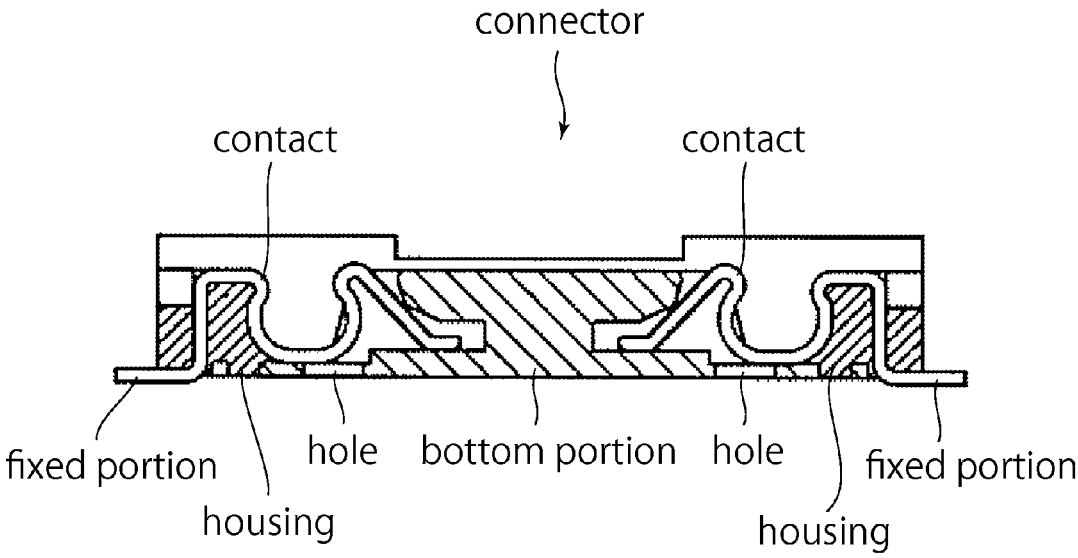
PRIOR ART FIG. 2
FIG. 2 is a cross-sectional view showing another existing connector.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 3 to 6, a connector 10 according to an embodiment of the present invention is configured to be mounted on a circuit board (not shown) for use.

The connector 10 comprises a plurality of contacts 20 each made of a conductive material and a housing 50 made of an insulating material. The connector 10 may further comprise a metallic member such as a reinforcement member, a shell or a hold-down.

Figure 3:
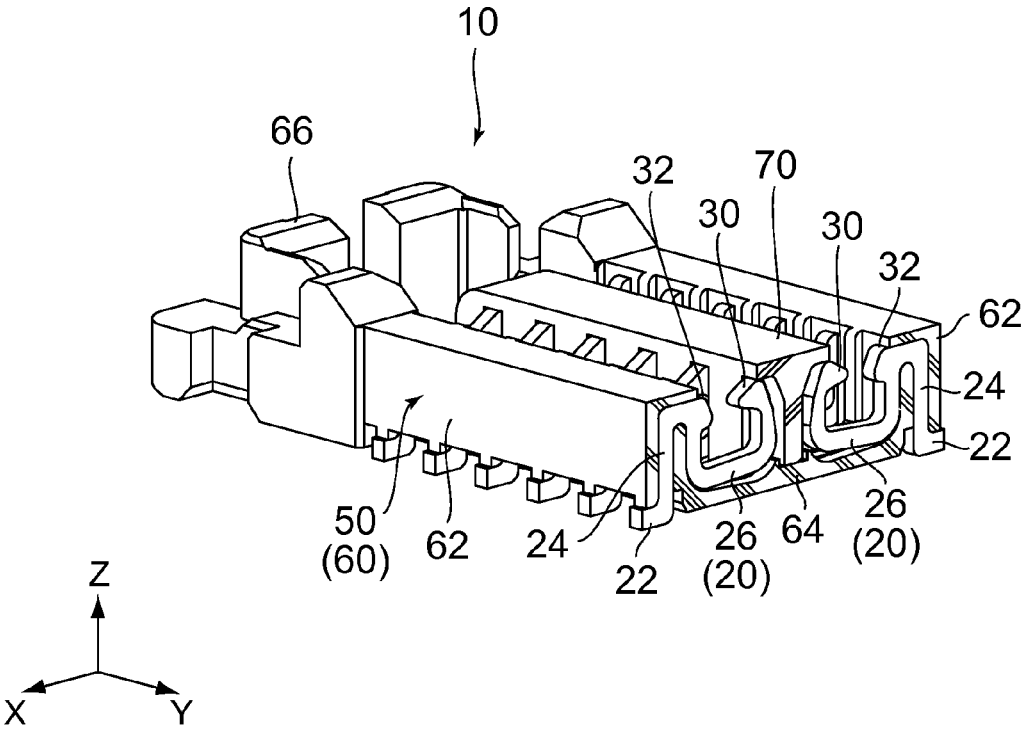
FIG. 3 is a partially cutaway, perspective view showing a connector according to an embodiment of the present invention.
Figure 4:
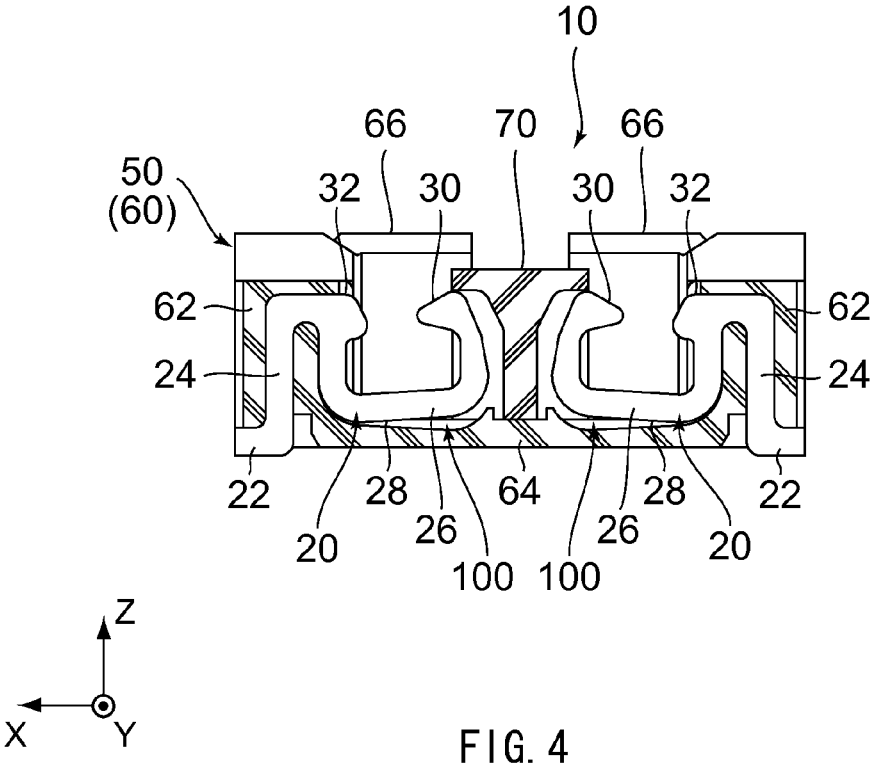
FIG. 4 is a cross-sectional view showing the connector of FIG. 3.
Figure 5:
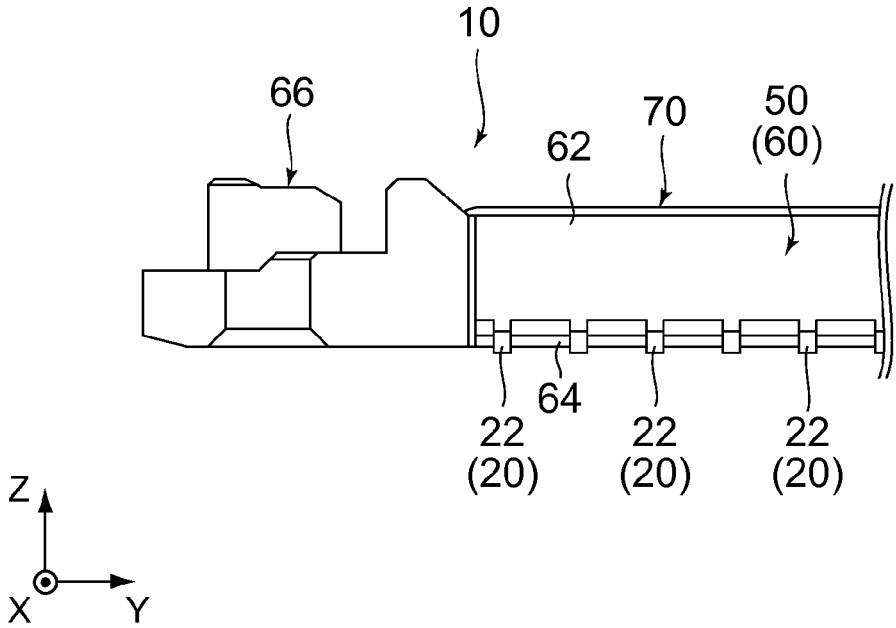
FIG. 5 is a partial, side view showing the connector of FIG. 3.
Figure 6:
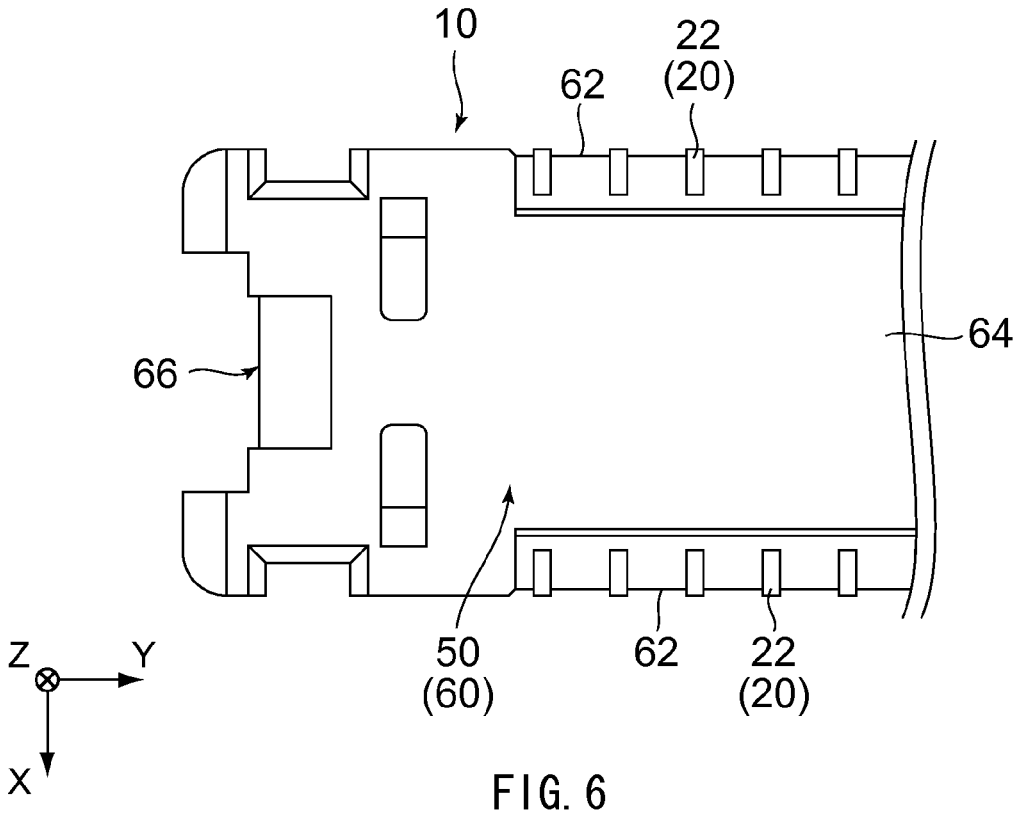
FIG. 6 is a partial, bottom view showing the connector of FIG. 3.

As can be seen from FIGS. 3, 5 and 6, the contacts 20 are classified into two groups. The contacts 20 of each of the groups are arranged in the Y-direction (pitch direction). The contacts 20 of one of the two groups are arranged back-to-back with the contacts 20 of another one of the two groups in the X-direction (predetermined direction), respectively. As shown in FIG. 4, the contacts 20 of one of the two groups and the contacts 20 of another one of the two groups are arranged symmetrically relative to the middle of the housing 50 in the X-direction.

As shown in FIG. 4, each of the contacts 20 has a fixed portion 22 configured to be fixed to the circuit board (not shown), a held portion 24 held by the housing 50, a spring portion 26 which is resiliently deformable, and a contact portion 30 supported by the spring portion 26. The contact portion 30 is connected to a contact of a mating connector (not shown) under a mated state where the connector 10 is mated with the mating connector (not shown). The contact portion 30 according to the present embodiment is supported by an end of the spring portion 26. The contact portion 30 protrudes outward in the X-direction. Thus configured contact portion 30 is movable because of the resilience of the spring portion 26. The spring portion 26 is provided with a protruding portion 32. The protruding portion 32 according to the present embodiment protrudes inward in the X-direction. The protruding portion 32 faces the contact portion 30 in the X-direction.

More specifically, the fixed portion 22 of the contact 20 according to the present embodiment has a short linear shape extending along the X-direction. The held portion 24 has an L-like shape. The held portion 24 extends toward the positive Z-side of the contact 20 (i.e. extends upward) in the Z-direction (vertical direction) from an inner end of the fixed portion 22 in the X-direction. The spring portion 26 has a U-like shape or a C-like shape opening toward the positive Z-side thereof (i.e. opening upward). Accordingly, the spring portion 26 has two ends. The spring portion 26 extends toward the negative Z-side of the contact 20 (i.e. extends downward) in the Z-direction from an inner end of the held portion 24 in the X-direction. The protruding portion 32 is provided at the one end, which is nearer to the held portion 24, of the spring portion 26. The contact portion 30 is provided at the other end (i.e. free end) of the spring portion 26.

As shown in FIGS. 3 and 4, the housing 50 according to the present embodiment is comprised of a first member 60 and a second member 70. The first member 60 has two sidewall portions 62, a bottom portion 64 and two end portions 66. Each of the sidewall portions 62 extends long in the Y-direction. The bottom portion 64 couples a negative Z-side end (i.e. lower end) of one of the sidewall portions 62 and a negative Z-side end of another one of the sidewall portions 62 with each other in the X-direction. Each of the end portions 66 couples an end of one of the sidewall portions 62 and an end of another one of the sidewall portions 62 with each other. The two sidewall portions 62 and the two end portions 66 form a frame body. The second member 70 has a block-like shape extending long in the Y-direction. The second member 70 is able to partially accommodate each of the contacts 20. According to the present embodiment, the second member 70 is put in the first member 60 after the first member 60 is formed.

As shown in FIGS. 3 and 4, each of the contacts 20 according to the present embodiment is partially embedded in the first member 60 of the housing 50 via insert-molding. In detail, the held portion 24 is held by the sidewall portion 62 via insert-molding. The held portion 24 is thus held so that the spring portion 26 is located inward of the sidewall portion 62 in the X-direction. In other words, the sidewall portion 62 is located outward of the spring portion 26 in the X-direction. The spring portion 26 is located over the positive Z-side (i.e. upper side) of the bottom portion 64 in the Z-direction. In other words, the bottom portion 64 is located under the negative Z-side (i.e. lower side) of the spring portion 26 in the Z-direction. The fixed portion 22 according to the present embodiment protrudes outward in the X-direction from the sidewall portion 62. The protruding portion 32 is not covered by the sidewall portion 62 and is visible when seen from the positive Z-side thereof (i.e. from above). Accordingly, the protruding portion 32 is able to be pressed from the positive Z-side thereof (i.e. from above) in the Z-direction.

As shown in FIG. 5, when the connector 10 according to the present embodiment is seen from the outside in the X-direction, the sidewall portion 62 of the first member 60 of the housing 50 hides the contact 20 for the most part so that only the fixed portion 22 of the contact 20 is visible. In other words, the sidewall portion 62 hides the contact 20 except the fixed portion 22 when the connector 10 is seen from the outside along the X-direction.

As shown in FIG. 6, the bottom portion 64 is formed from a part of a single member, namely, the first member 60. The bottom portion 64 is provided with no holes corresponding to the contacts 20, respectively. Accordingly, when the connector 10 according to the present embodiment is seen from the negative Z-side thereof (i.e. from below) in the Z-direction, the bottom portion 64 of the first member 60 of the housing 50 hides the contact 20 for the most part so that only the fixed portion 22 of the contact 20 is visible. In other words, the bottom portion 64 hides the contact 20 except the fixed portion 22 when the connector 10 is seen from the negative Z-side thereof (i.e. from below) along the Z-direction.

As described above, according to the present embodiment, only the fixed portion 22 of the contact 20 is visible when the connector 10 is seen from the negative Z-side thereof (i.e. from below) in the Z-direction or from the outside in the X-direction. Accordingly, only the fixed portion 22 of the contact 20 is exposed out of the housing 50, particularly under the mated state. According to the present embodiment, there is little possibility that the contact 20 is contaminated.

As best shown in FIG. 4, under an unmated state of the connector 10 according to the present embodiment, the housing 50 has a gap 100 between a lower surface 28 of the spring portion 26 and the bottom portion 64 of the first member 60 thereof. Accordingly, the spring portion 26 is resiliently deformable or shows resilience within the gap 100. Moreover, the gap 100 for resilient deformation of the spring portion 26 is provided at the negative Z-side of the spring portion 26 (i.e. under the spring portion 26) so that the contact 20 is not required to have a large size in the X-direction. According to the present embodiment, the connector 10 may have a reduced size in the X-direction.

If the contact 20 is ordinarily held by the housing 50 via insert-molding, it is difficult to provide the gap 100 between the spring portion 26 and the bottom portion 64 while hiding the most part of the contact 20 by the bottom portion 64. According to an existing insert-molding, it is necessary to form a hole or an opening piercing the bottom portion 64 of the housing 50 in order to provide a space for resilient deformation of the spring portion 26 under the spring portion 26 of the contact 20. In other words, if the contact 20 is embedded into the housing 50 via the existing insert-molding, the spring portion 26 of the contact 20 is buried in the bottom portion 64 unless the bottom portion 64 is formed with a hole. The spring portion 26 is therefore unable to show the resilience.

Unlike the existing insert-molding, during the first member 60 is formed via insert-molding according to the present embodiment, the spring portion 26 is applied with a stress which maintains the spring portion 26 in a resiliently deformed state so that the gap 100 according to the present embodiment is formed.

Figure 7:
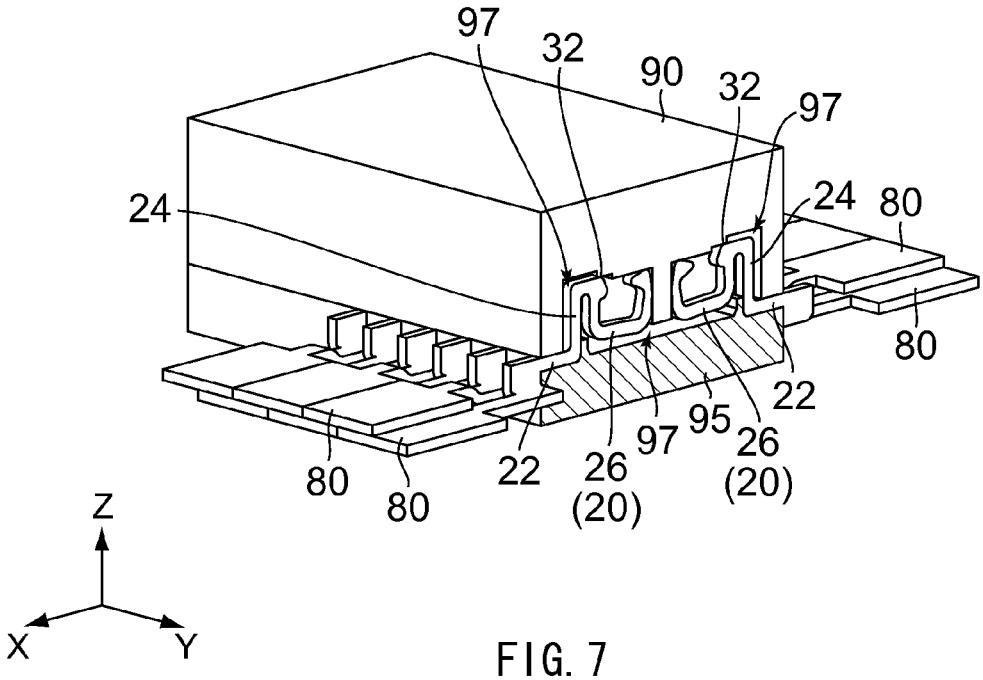
FIG. 7 is a partially cutaway, perspective view for explanation of a manufacturing process of the connector of FIG. 3.

In detail, as shown in FIG. 7, the contacts 20 with carriers 80 are held by an upper die 90 and a lower die 95. Then, a resin is poured into a cavity 97 formed by the upper die 90 and the lower die 95 so that the first member 60 of the housing 50 according to the present embodiment is formed. During the forming of the first member 60, the fixed portion 22 of each of the contacts 20 is caught between the upper die 90 and the lower die 95, and the protruding portion 32 is brought into contact with the upper die 90. In other words, the upper die 90 and the lower die 95 support three parts of the contact 20, namely, the positive Z-side surface (i.e. upper surface) of the fixed portion 22, the negative Z-side surface (i.e. lower surface) of the fixed portion 22 and the protruding portion 32. The contact 20 is thus supported so that it is possible to prevent the contact 20 from rotating in the XZ-plane.

Figure 8:
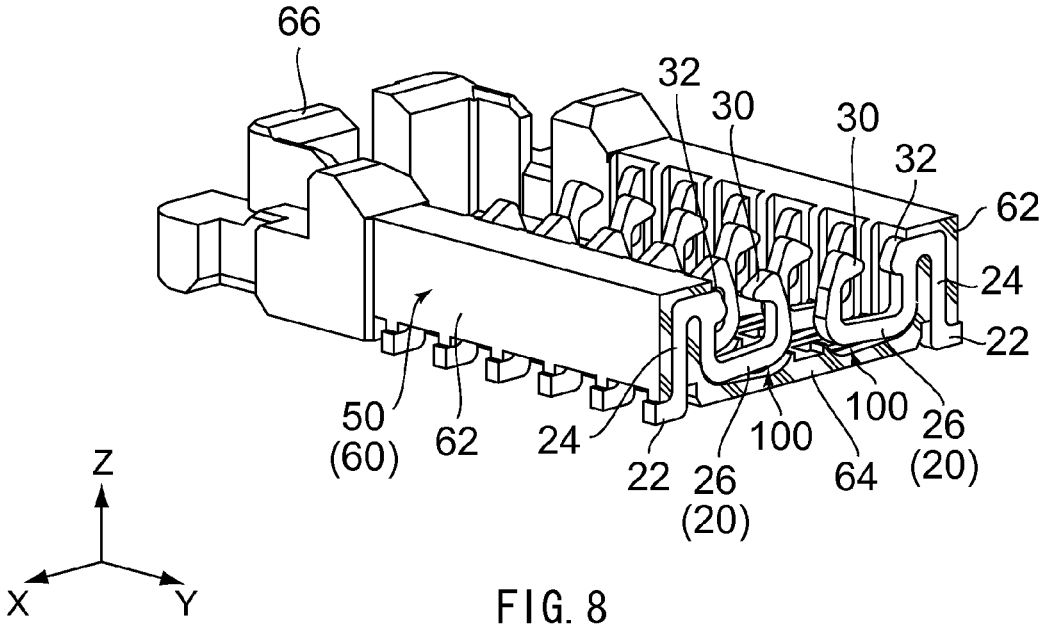
FIG. 8 is another partially cutaway, perspective view for explanation of the manufacturing process of the connector of FIG. 3.

According to the present embodiment, when the contact 20 is in the aforementioned supported state, the upper die 90 is pressed against and applies a load to the free end of the spring portion 26 or the contact portion 30. The load moves the contact portion 30 along the negative Z-direction (i.e. moves downward) from the initial position under the unmated state (see FIGS. 3 and 8). In other words, the spring portion 26 of the contact 20 is resiliently deformed during insert-molding. As shown in FIG. 8, when the upper die 90 and the lower die 95 are detached after insert-molding, the resilience of the spring portion 26 returns the spring portion 26 to the initial position under the unmated state. Accordingly, the gap 100 is formed between the lower surface 28 of the spring portion 26 and the bottom portion 64 of the first member 60 of the housing 50.

Thereafter, as shown in FIG. 8, the carriers 80 are cut off from the contacts 20. Then, the second member 70 is put in the first member 60 so that the connector 10 shown in FIG. 3 is obtained.

Figure 9:
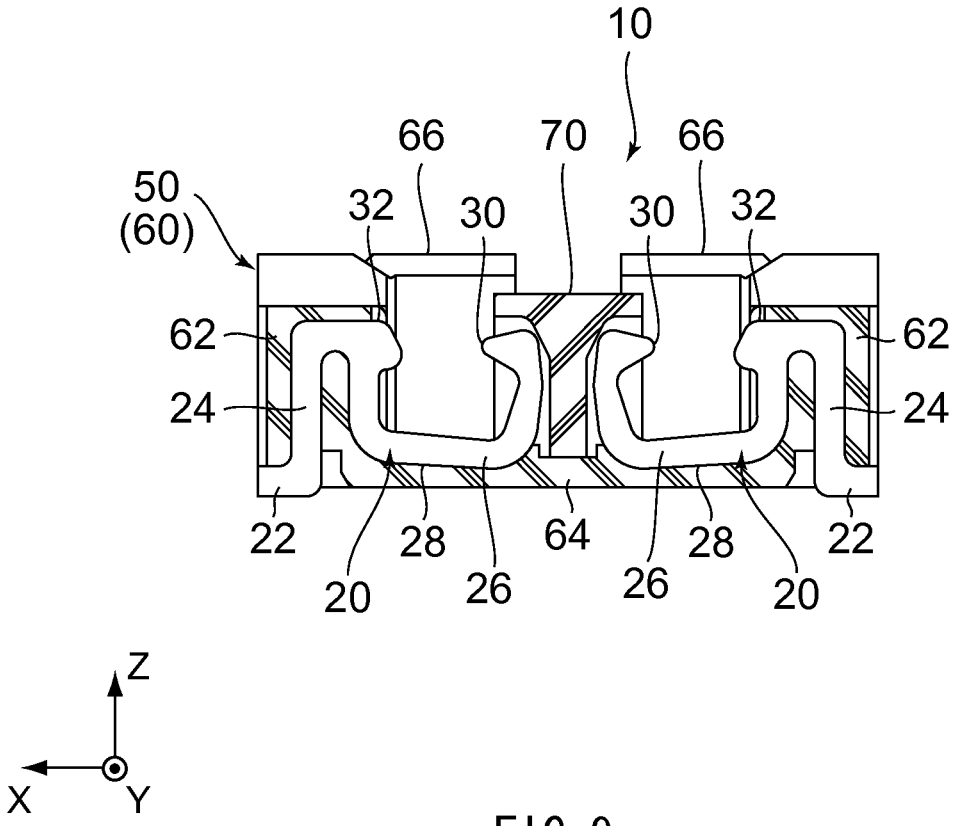
FIG. 9 is a cross-sectional view, similar to FIG. 4, showing the spring portion resiliently maximally deformed.

As best shown in FIG. 4, the gap 100 according to the present embodiment is formed as described above so that the bottom portion 64 has a shape formed by partially printing the shape of the spring portion 26. More specifically, as shown in FIG. 9, the bottom portion 64 has the shape that allows the lower surface 28 of the spring portion 26 and the bottom portion 64 to be brought into contact with each other without any gaps if the spring portion 26 is resiliently maximally deformed toward the negative Z-side of the contact 20 (i.e. deformed downward), that is to say, if the spring portion 26 is further resiliently deformed from the shape under the mated state of the connector 10 with the mating connector (not shown). As described above, according to the present embodiment, the gap 100 for the resilient deformation of the spring portion 26 is formed between the spring portion 26 and the bottom portion 64 even if the contact 20 is held by the first member 60 of the housing 50 via insert-molding.

According to the aforementioned embodiment, the fixed portion 22 protrudes outward in the X-direction from the sidewall portion 62 of the housing 50. However, the fixed portion 22 may be formed differently. For example, the fixed portion 22 may not protrude outward in the X-direction from the sidewall portion 62 of the housing 50 if not the fixed portion 22 but a part of the carrier 80 is put between the upper die 90 and the lower die 95 during insert-molding.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector configured to be mounted on a circuit board, the connector comprising:

a contact having a fixed portion, a contact portion, a spring portion, and a held portion, the fixed portion being configured to be fixed to the circuit board, the spring portion supporting the contact portion, the held portion being located between the fixed portion and the spring portion; and a housing having a sidewall portion and a bottom portion, the sidewall portion being located outward of the spring portion in a predetermined direction and holding the held portion, the bottom portion being located under the spring portion in a vertical direction perpendicular to the predetermined direction, the housing having a gap between a lower surface of the spring portion and the bottom portion, and the bottom portion and the sidewall portion hiding the contact except the fixed portion both when the connector is seen from below along the vertical direction and when the connector is seen from outside along the predetermined direction, wherein:

an upper surface of the bottom portion and the lower surface of the spring portion have curved surfaces that correspond to each other; and the lower surface of the spring portion and the bottom portion are brought into contact with each other without any gap therebetween when the spring portion is resiliently maximally deformed downward.

2. The connector as recited in claim 1, wherein the held portion is held by the sidewall portion via an insert-molding process.

3. The connector as recited in claim 1, wherein:

the fixed portion protrudes outward from the sidewall portion in the predetermined direction; and the spring portion has a protruding portion which is arranged to be able to be pressed from above in the vertical direction.

4. The connector as recited in claim 1, wherein:

the fixed portion extends in the predetermined direction;

the held portion has an L-like shape and extends upward in the vertical direction from an inner end of the fixed portion in the predetermined direction; and the spring portion has a U-like shape and extends downward in the vertical direction from an inner end of the held portion in the predetermined direction.

* * * * *